US006327339B1

(12) United States Patent
Chung et al.

(10) Patent No.: US 6,327,339 B1
(45) Date of Patent: Dec. 4, 2001

(54) INDUSTRIAL X-RAY/ELECTRON BEAM SOURCE USING AN ELECTRON ACCELERATOR

(76) Inventors: Kie Hyung Chung, 479 Jookbaek-dong, Pyongtak, Kyunggi-do; Kang Ok Lee, 605-406 Chukong-Apt, Sanggye-7 dong, Nowon-ku, Seoul; Hyeok Jung Kwon, 6-407 Dongah-Apt, Pupyong-1 dong, Pupyong-ku, Inchon; Sang Ho Kim, 101-1205 Samho-Apt, Sangdo-dong, Tongjak-ku, Seoul, all of (KR)

( * ) Notice: Subject to any disclaimer, the term of this patent is extended or adjusted under 35 U.S.C. 154(b) by 0 days.

(21) Appl. No.: 09/450,477

(22) Filed: Nov. 29, 1999

(30) Foreign Application Priority Data

Mar. 25, 1999 (KR) ..... 99-10396

(51) Int. Cl.[7] ..... H05H 13/10

(52) U.S. Cl. ..... 378/121; 378/119; 250/505.1; 315/506; 315/507; 315/5.41; 315/5.42

(58) Field of Search ..... 378/119, 121; 250/505.1; 315/500, 506, 507, 5.41, 5.42

(56) References Cited

U.S. PATENT DOCUMENTS 4,211,954 * 7/1980 Swenson ..... 315/5.41
4,618,970 * 10/1986 Rand et al. ..... 378/10
4,794,340 * 12/1988 Ogasawara ..... 315/503
5,814,940 * 9/1998 Fujisawa ..... 315/5.41
6,060,833 * 5/2000 Velazco ..... 315/5.41

FOREIGN PATENT DOCUMENTS 01-176644 7/1989 (JP) .
H7-318698 12/1995 (JP) .

* cited by examiner

*Primary Examiner*—Robert H. Kim
*Assistant Examiner*—Allen C Ho
(74) *Attorney, Agent, or Firm*—Lee & Hong

(57) ABSTRACT

An industrial X-ray/electron beam source includes an accelerator having a) a coaxial cavity b) an electron gun for emitting an electron beam to be accelerated, c) at least one deflection magnet positioned outside of the cavity, and d) a radio frequency power supply means for supplying power of a radio frequency to the cavity to induce $TM_{010}$ mode as an accelerating mode in the cavity; and a beam irradiator having a two-dimensional scanning magnet which deflects accelerated beam by the accelerator, an extracting window for extracting the deflected electron beam to be irradiated to an object, and means for guiding the deflected beam toward a center of the extracting window in a radial direction. The source is advantageous in that the electron beams do not intersect inside the cavity, which can reduce beam loss, and that beams or X-rays are irradiated to the object spatially uniformly.

10 Claims, 6 Drawing Sheets

INDUSTRIAL X-RAY/ELECTRON BEAM SOURCE USING AN ELECTRON ACCELERATOR

CROSS REFERENCE TO RELATED ART

This application claims the benefit of Korean Patent Application No. 1999-10396, filed on Mar. 25, 1999, which is hereby incorporated by reference.

BACKGROUND OF THE INVENTION

1. Field of the Invention

The present invention relates to an X-ray and electron beam source using an electron accelerator, and more particularly to the source having a continuous wave electron accelerator which can accelerate electrons to 10 MeV with power levels up to several hundreds kW and a beam irradiator which can irradiate the electron beam toward a target in a radial direction thereof.

2. Description of the Related Art

Industrial electron beam accelerator can be classified into a DC(direct current) accelerating type and a RF(radio-frequency) accelerating type in accordance to the accelerating method.

The former accelerates electrons by applying a DC voltage corresponding to the desired beam energy between electrodes, and it can obtain a continuous wave beam and has high efficiency of energy conversion. However, the size of apparatus must be enlarged according to the desired high energy, thus it can be used only for below 5 MeV beam energy.

The latter accelerates electrons by using travelling waves or standing waves, and can obtain high energy beam with a relatively small apparatus in comparison to the former type.

By the way, for industrial use the beam energy of the accelerator is preferably lower than 10 MeV, owing to the activation of the irradiated object. Thus the RF accelerating type for industrial use is mainly used for between 5 and 10 MeV.

Industrial accelerators for 10 MeV in use includes RF Linac(radio frequency linear accelerator) and "Rhodotron" which was proposed in document WO-A-88/09597(Atomic Energy Commission).

The RF Linac uses the accelerating principle of high energy linear electron accelerator which is widely used in science study, and accelerates electrons using travelling waves.

In RF Linac with a high power, beam may not be stable, since the accelerating cavity is distorted owing to non-uniform heat resulting from beam loss and RF power dissipation in the cavity wall. Because of this problem, the average output power of RF Linac is limited up to about 25 kW.

Whereas, since Rhodotron has a coaxial cavity using electromagnetic waves with low frequency having wavelength of several meters, heat load of cavity resulting from the RF power loss is smaller than that of RF Linac, which means that it can obtain high power electron beam. Therefore Rhodotron is mainly used for the industrial field requiring 10 MeV energy and more than 25 kW beam power.

However, since the standing wave mode for accelerating electrons in Rhodotron is TEM(transverse electromagnetic wave) mode, which may result intersection of plurality of beams around the center of the accelerating cavity, the beam loss may happen in case of high output power.

The beam irradiator is an apparatus for irradiating beams accelerated by accelerators to irradiate medical devices, cables, food, and so on. When it is used as an electron beam irradiator, it has an extracting window in the beam extracting part to maintain pressure difference between the atmospheric pressure and vacuum inside the beam irradiator, and when it is used as an X-ray irradiator, it has a target for producing X-rays. Therefore, except extracting part, the structures of the irradiators for X-ray source and electron beam source are same with each other.

A conventional X-ray irradiator irradiates electron beams 74 to impact a flat plate shaped X-ray target 76, through which the electron beams are converted into X-rays and are irradiated to the objects, as shown in FIG. 5.

By the way, according to above prior technique, X-rays are irradiated to the object only in one direction, which means that irradiation of X-rays is not uniform, which damages the object and deforms the object owing to local heating.

In order to solve the above problems, a supplementary apparatus for rotating the object while irradiating it may be prepared. But, it is inconvenient and the kinds of applicable objects for the apparatus are limited.

Furthermore, in case of producing X-rays by Bremsstrahlung accelerated electrons with energy above several MeV produce X-rays that have maximum intensity in the forward direction with narrow angle.

However, according to the prior art, since the scanning magnets deflect electrons during accelerating, before impacting the flat target 76, the incident electrons can not impact the target 76 perpendicularly. Thus the produced X-rays are not irradiated with maximum intensity, which results in loss of X-rays.

SUMMARY OF THE INVENTION

Therefore a purpose of the present invention is to provide an industrial electron beam/X-ray source having an electron accelerator with 10 MeV beam energy and up to several hundreds kW output power, which does not permit intersection of electrons in the cavity, and an irradiator which can uniformly irradiate electron beams/X-rays to the object.

According to one preferred embodiment of the present invention, a electron beam and X-ray source includes an accelerator having a) a cavity defined by an outer cylindrical conductor and an inner cylindrical conductor, the conductors being coaxial and being joined by side conductors to their opposite ends thereby defining a vacuum space;

b) an electron gun for emitting an electron beam to be accelerated, in the longitudinal direction of the cylindrical conductors, the electron beam being injected into the cavity along a first passage;

c) at least one deflection magnet positioned outside of the cavity, the one magnet intercepting the electron beam after passage through the cavity along the first passage and deflecting the beam, the deflected beam being reinjected into the cavity along a second passage in the longitudinal direction of the conductors; and d) a radio frequency power supply means for supplying power of a radio frequency to the cavity to induce an electric field of $TM_{010}$ mode as an accelerating mode for the cavity, and a beam irradiator for irradiating the accelerated beam to an object.

According to another embodiment of the present invention, the accelerator has two cavities to reduce number of deflection magnets.

The cavity of the present invention is preferably housed in a vacuum vessel.

The irradiator according to the present invention preferably includes a 2-dimension scanning magnet which deflects the electron beam in x-y direction; an extracting window where the electron beam is extracted; and a means for guiding the deflected electron beam to the center of the window in radial direction.

The beam is preferably guided by a magnetic circuit.

Other elements, features, advantages and components of preferred embodiments of the present invention will be described in further detail with reference to the drawings attached hereto.

BRIEF DESCRIPTION OF THE DRAWINGS

The accompanying drawings, which are incorporated in and constitute a part of the specification, illustrate preferred embodiments of the present invention, and together with the description, serve to explain the principles of the present invention.

DESCRIPTION OF THE PREFERRED EMBODIMENTS

Figure 1:
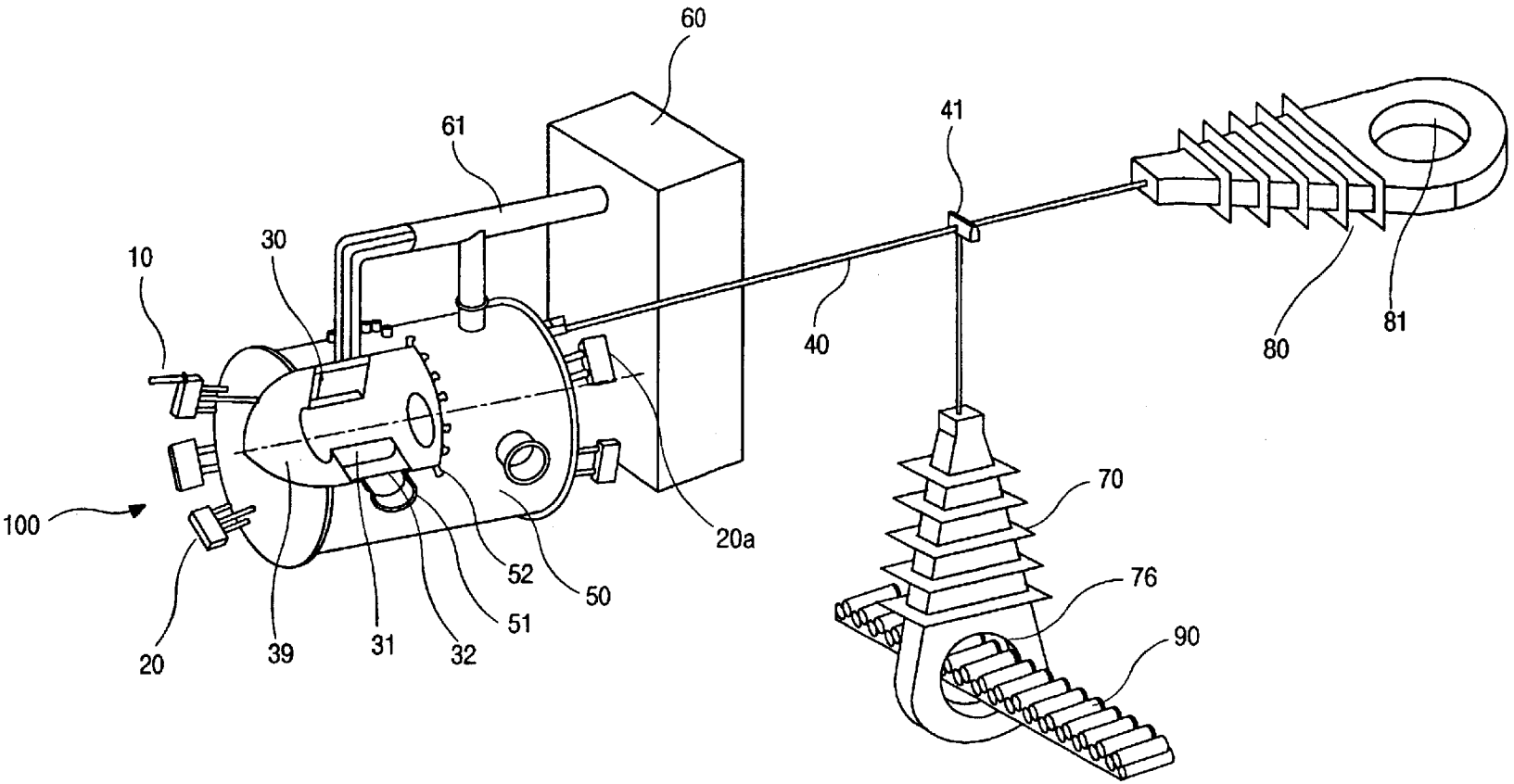
FIG. 1 is a partially cutaway view of a X-ray and electron beam source according to an embodiment of the present invention.

The preferred embodiment of the present invention will be explained with reference to the accompanying drawings, FIG. 1 is a schematic view of a X-ray and electron beam source according to an embodiment of the present invention, and for easy understanding of the source is partially cutaway. The source system includes an accelerator 100 having a coaxial cavity, and a X-ray irradiator 70 and an electron beam irradiator 80 which are connected to the accelerator 100 via a beam line 40.

The accelerator 100 has a coaxial cavity 30, an electron gun 10 which injects electron beams in the cavity 30, a plurality of deflection magnets 20 and 20*a* which deflects electrons passing through the cavity 30 and reinjects the electrons in the opposite direction, and a radio frequency power supplier 60 for supplying power of a radio frequency to the cavity 30 to induce a predetermined electric field.

The cavity 30 includes an inner cylindrical conductor 31 and an outer cylindrical conductor 32, which are coaxial and joined by side conductors 39 having passages to the electron gun 10 and deflection magnets 20 and 20*a*. A waveguide 61 for transmitting RF power into the cavity 30 is connected to the outer conductor 32 by an input coupler (not shown). The waveguide 61 may be replaced by a coaxial line.

According to this embodiment, there are shown two cavities 30 in series in FIG. 1, the structure of two cavities 30 will be explained in detail with reference to FIG. 2.

The cavity 30 is preferably housed in a vacuum vessel 50, which can sustain pressure difference between atmospheric pressure and vacuum. In this case, the electron gun 10 and deflection magnets 20 and 20*a* are positioned outside wall of the vacuum vessel 50. The vessel 50 maintains vacuum through a vacuum port 51 which is connected to a vacuum pump (not shown). The cylindrical vessel 50 has a plurality of diagnostics ports 52 in its outer circumference. The deflection magnets 20 and 20*a* are preferably disposed in the outside wall of the vessel 50 in the radial direction.

RF power supplier 60 supplies RF power to the cavity 30 to induce a $TM_{010}$ mode as an accelerating mode for the cavity. $TM_{010}$ mode is that the magnetic field is transverse to the direction of propagation of the electro magnetic wave, and that an imaginary coaxial surface distant from the center axis of the cavity 30 by a predetermined value has a maximum electric field and 0(zero) magnetic field value. The beams are accelerated along the imaginary coaxial surface.

The supplier 60 uses a grid tube (not shown) as a radio frequency source.

Now, the operation of the accelerator according to the embodiment will be explained.

The electron gun 10 mounted on a side wall of the vacuum vessel 50 injects electrons into the accelerating cavity 30, and the electrons are accelerated along the imaginary surface by the accelerating field of the cavity 30.

The accelerated electrons are intercepted and deflected by a deflection magnet 20*a* which is mounted on the opposite side of the electron gun 10 in the longitudinal direction of the cavity 30. The deflected electrons are reinjected into the cavity 30 and accelerated till they are deflected by a deflection magnet 20 which is mounted on the side of electron gun 10. The electrons can reach 10 MeV through the above accelerating mechanism.

The accelerator 100 according to this invention uses electromagnetic waves with wavelength of several meters (the frequency is about between 100 and 200 MHz), thus heat load of the cavity 30 is relatively small, which enables the accelerator 100 to obtain high power electron beams up to hundreds kW. Also electron beams with diverse output energy can be obtained if an output port is mounted on a predetermined deflector 20*a*.

In this accelerating mechanism, the gyroradius of electron in the magnetic field is determined by the kinetic energy of the electron and applied magnetic flux density, thus to synchronize the electrons to the accelerating RF period, the magnetic flux density and position of deflection magnet should be determined according to the electron energy in every accelerating stage. In this case, a focusing magnet (not shown) can be added if necessary.

The synchronization between electrons and RF accelerating phase can be easily achieved, as explained above.

The accelerated beams reach an X-ray irradiating apparatus 70 having a target 76 for producing X-rays, and an electron beam irradiating apparatus 80 having an extracting window 81 via a 90° deflection magnet 41 to irradiate the X-rays or electron beams to the object 90.

The conversion efficiency from electromagnetic waves to electron beams of the accelerator 100 is limited by number of deflection magnets positioned outside of the cavity 30, thus the accelerator according to this embodiment preferably has two cavities to reduce number of magnets 20 and 20*a*.

Figure 2:
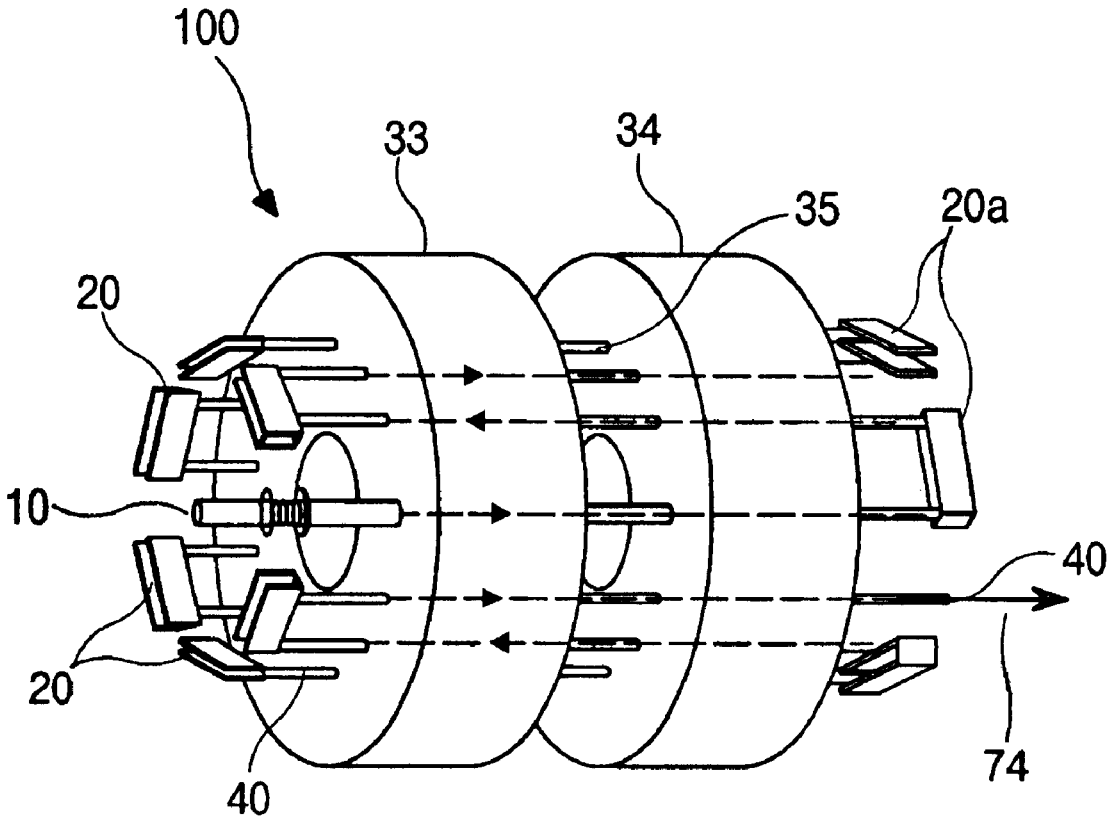
FIG. 2 is a perspective view showing an accelerator having two cavities according to the embodiment of the present invention.

To explain the principle of the two cavities in detail, FIG. 2 is a view showing two cavities 33 and 34. The phase difference of the electromagnetic waves between the first and second cavities 33 and 34 is 180°. The incident electrons from the electron gun 10 are accelerated within the first cavity 33, and if length of the beam line 35 between the first and second cavities 33 and 34 and longitudinal length of the cavities 33 and 34 are properly chosen, the incident electrons into the second cavity 34 are accelerated in the accelerating electric field again. The electrons after passing through the second cavity 34 are intercepted and deflected to be reinjected into the second cavity 34 by the deflectors 20*a,* and they are accelerated within the second cavity 34. In this operation, since the electron beams are accelerated twice between the opposing deflection magnets 20 and 20*a*. the number of magnets 20 and 20*a* can be reduced to obtain the desired beam with the same output energy.

Figure 3A:
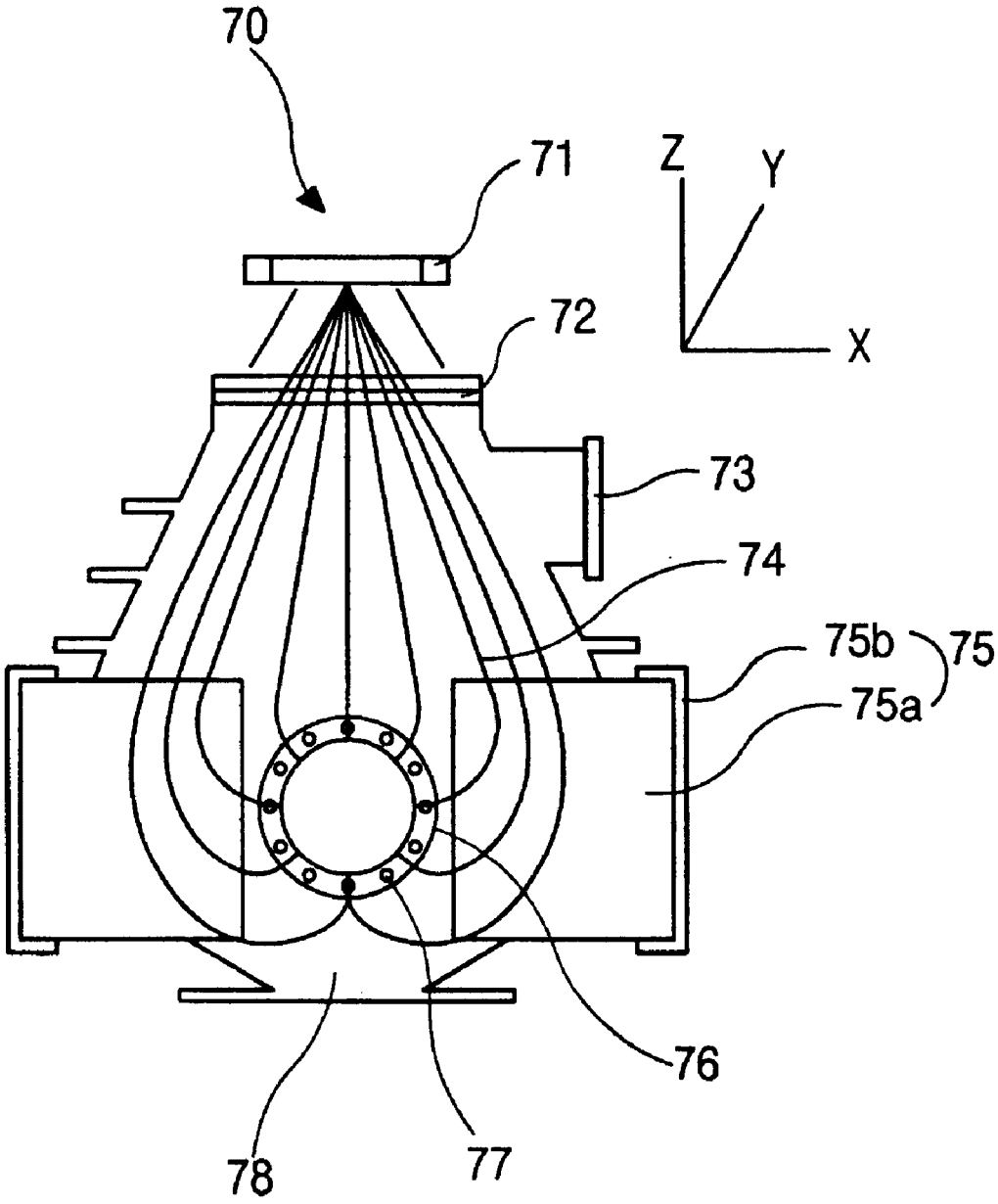
FIGS. 3A and 3B are a plan view and a side view of X-ray irradiator according to the present invention, respectively.
Figure 3B:
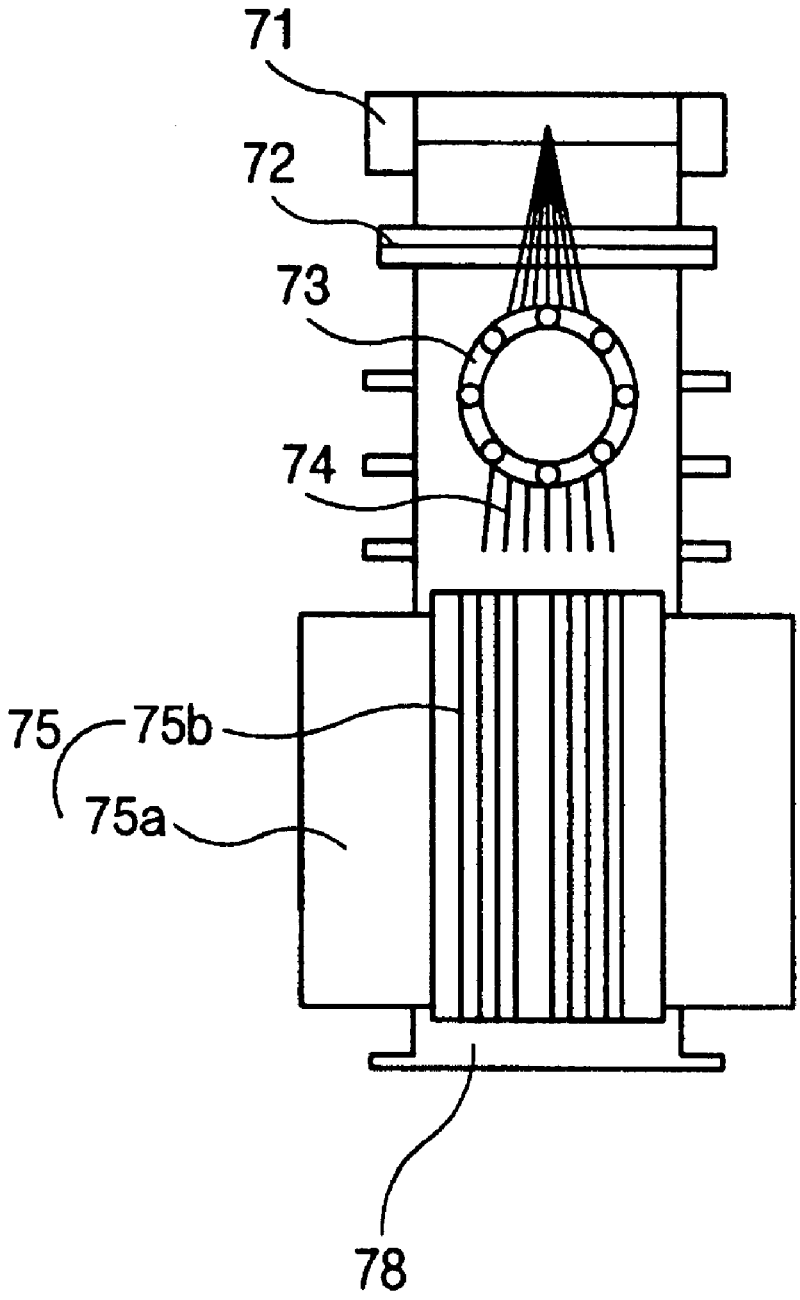

FIGS. 3A and 3B are schematic views showing X-ray irradiator of FIG. 1. The explanation for the electron beam irradiator of FIG. 1 is omitted since there is no difference between the X-ray irradiator and beam irradiator except the extracting window in the beam irradiator. Thus the explanation for X-ray irradiator will be enough and the understanding of electron beam irradiator can be easily done if the target is replaced by the extracting window.

Following is the operation condition of X-ray irradiator 70 in accordance to the object of the present invention, i.e. to uniformly irradiate X-ray to the object in all directions. The accelerated electrons should be uniformly injected toward center of the target 76 with uniform circumferential distribution and the incident angle is preferably 90°.

To meet the above condition, the irradiator 70 according to the present invention includes a two-dimensional scanning magnet 71 which can deflect the electrons in the transverse directions i.e. x and y directions, and a magnetic circuit for deflecting electrons toward the center of the target 76.

When high power electrons pass through the 2-dimensional scanning magnet 71, they are deflected in the transverse directions.

If the incident electron beams after x-direction scanning are uniform, uniform irradiation toward the center of the target 76 cannot be accomplished. To overcome this problem, i.e. to uniformly irradiate the electrons to the target in the radial direction, when regarding x-direction scanning, the amount of the beams irradiated around both upper and lower ends of the target 76 should be more than that of the beams irradiated around the side of the target 76. To satisfy this condition, the deflection in the x-direction should be controlled, which can be achieved by controlling the current waveform of the scanning magnet 71 in accordance with time.

The deflected electrons by the 2-dimensional scanning magnet 71 reaches a region defined by magnetic circuit 75. In the region of the circuit 75, the electrons are uniformly injected toward the center of the target 76 with uniform circumferential distribution by Lorenz force.

Figure 4:
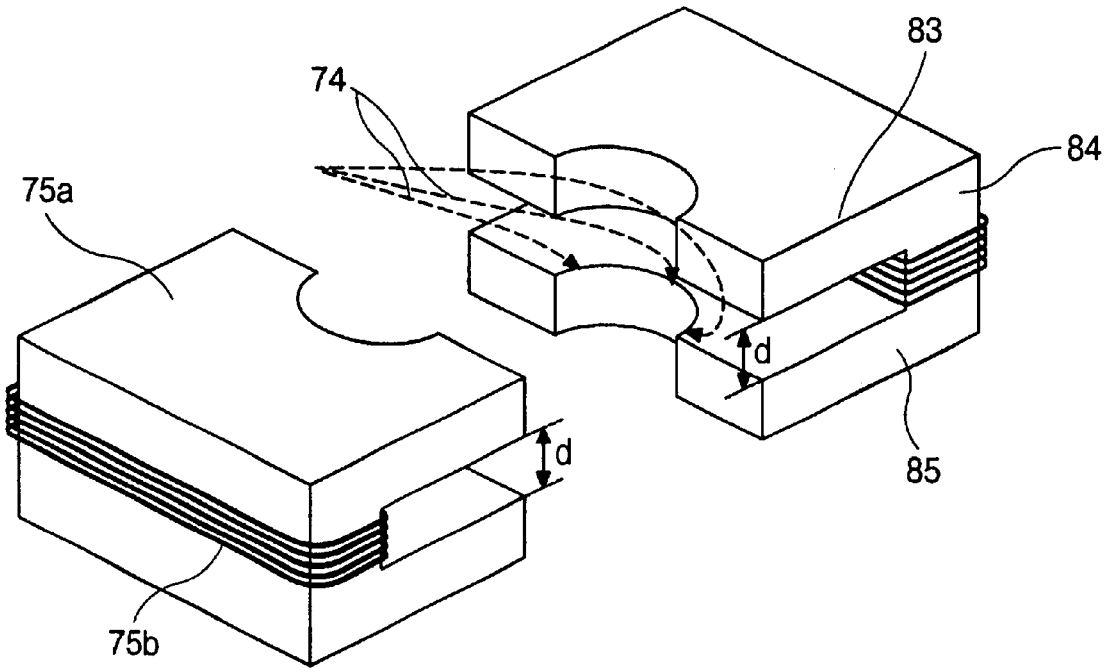
FIG. 4 is a view for more understanding of a magnetic circuit of FIGS. 3A and 3B.
Figure 5:
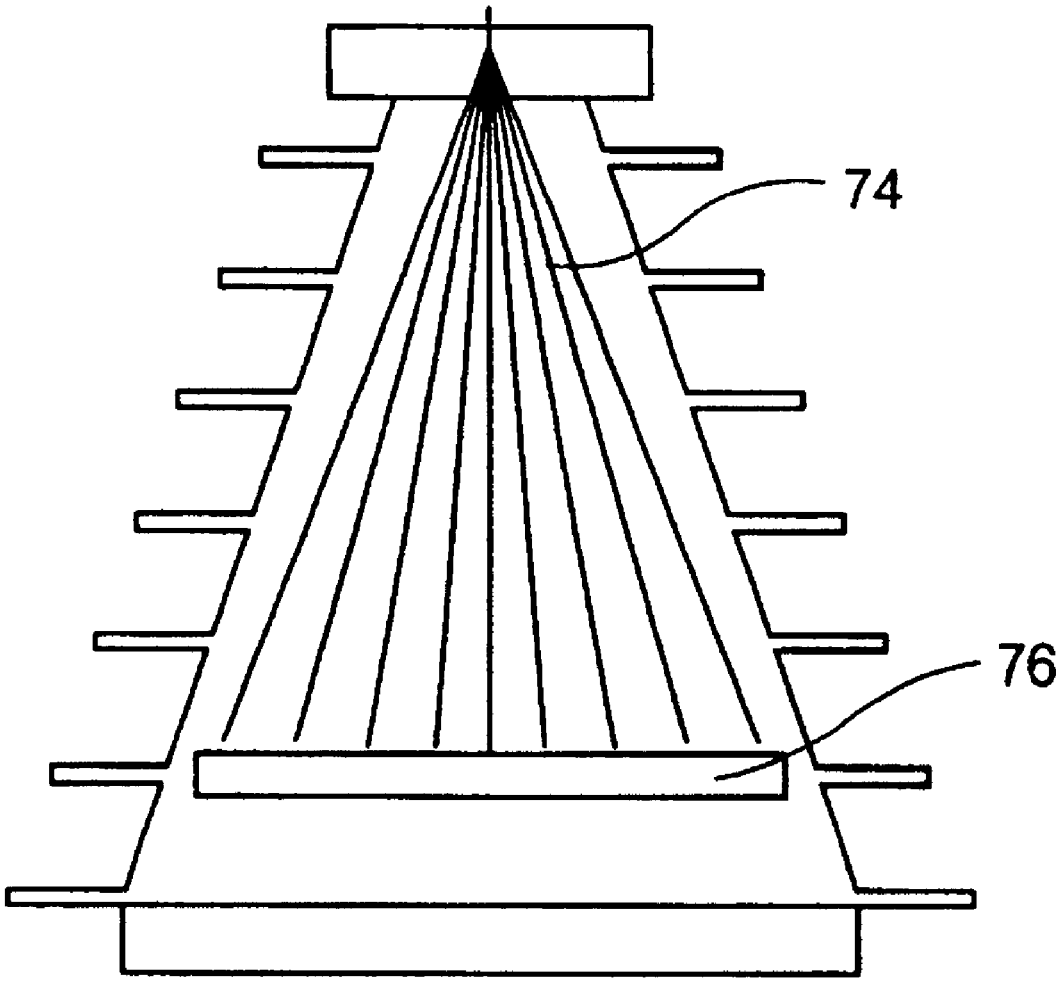
FIG. 5 is a plan view of a conventional X-ray irradiator.

There is shown a magnetic circuit 75 in FIG. 4, where it is viewed in a different direction from FIGS. 3A and 3B for better understanding.

Though magnetic circuit 75 shown in FIG. 4 is divided into two sections 75*a* and 75*b,* any configuration of magnetic circuit can be adopted. For example, an integrated magnetic circuit can be designed for the same purpose. The magnetic circuit 75 forms a magnetic field to deflect the electrons toward center of the target 76 in radial direction.

The magnetic circuit 75 is structured such that orbits 74 of the electron beams can pass between the two poles 83 and 85 which are combined by a connecting member 84, where solenoid coils 75*b* are coiled. Desired magnetic flux density between the poles 83 and 85 is determined by a gap distance d, which is determined regarding magnetomotive force (number of turn×current), distance from the scanning magnet 71, and position of the target 76.

To cool the heat occurring from the incident electrons with high energy of several MeV, it is preferable to form cooling passages 77 in the target 76.

Furthermore, when accelerated electrons are injected into the target 76, atoms of the target 76 are sputtered. Moreover, gases are desorbed through diverse mechanisms. The sputtered atoms and the gases flow into the accelerator 100 (see FIG. 1), which results in loss of electron beam. Thus, to maintain vacuum condition in the irradiator 70, the accelerator 100 is isolated from a vacuum chamber 78, which maintains vacuum by a vacuum pump (not shown) via a vacuum port 73.

The above-explained X-ray and electron beam source according to the present invention has following advantages.

First, since the accelerator uses $TM_{010}$ mode as an accelerating mode, the electron beams do not intersect inside the cavity, thus electron beam loss can be prevented.

Second, since the source of the present invention has a vacuum vessel for housing the cavity, the deformation of the cavity by the atmospheric pressure can be prevented.

Third, since the accelerator uses a grid tube as a RF source and proper frequency of about 200 MHz, the whole apparatus can be compact.

Fourth, according to the irradiator of the present invention, the deflected beams are injected toward center of the target or the beam extracting window in the perpendicular direction with respect to the tangent line of the target, which enables the irradiation to be spatially uniform.

Other features and advantages of the present invention can be understood in the above-preferred embodiments.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

For example, the configuration of the magnetic circuit can be modified for specific application, and the number of the cavity can be one.

What is claimed is:

1. An industrial X-ray/electron beam source, comprising:

an accelerator having a) a cavity defined by an outer cylindrical conductor and an inner cylindrical conductor, the conductors being coaxial and being joined by side conductors to their opposite ends thereby defining a vacuum space, b) an electron gun for emitting an electron beam to be accelerated, in a longitudinal direction of the cylindrical conductors, the electron beam being injected into the cavity along a first passage, c) at least one deflection magnet positioned outside of the cavity, the one magnet intercepting the electron beam after passage through the cavity along the first passage and deflecting the beam, the deflected beam being reinjected into the cavity along a second passage in the longitudinal direction of the conductors, and d) a radio frequency power supply means for supplying electromagnetic power of a radio frequency to the cavity to induce a $TM_{010}$ mode as an accelerating mode in the cavity; and a beam irradiator for irradiating the accelerated beam to an object.

2. A source according to claim 1, wherein the cavity is housed in a vacuum vessel to prevent deformation of the cavity by atmospheric pressure.

3. An industrial X-ray/electron beam source, comprising:

an accelerator having a) a first and a second cavities, each defined by an outer cylindrical conductor and an inner cylindrical conductor, the conductors being coaxial and being joined by side conductors to their opposite ends thereby defining a vacuum space, the cavities being connected by at least one beam line in an accelerating direction and being axial, b) an electron gun for emitting an electron beam to be accelerated, in a longitudinal direction of the cylindrical conductors, the electron beam being injected into the first cavity along a first passage from the first cavity to the second cavity, c) at least one deflection magnet positioned outside of the cavities, the one magnet intercepting the electron beam after passage through the first and the second cavities along the first passage and deflecting the beam, the deflected beam being reinjected into the cavities along a second passage in the longitudinal direction of the conductors, and d) a radio frequency power supply means for supplying power of a radio frequency to the cavities to apply $TM_{010}$ mode as an accelerating mode in the cavities; and a beam irradiator for irradiating the accelerated beam to an object.

4. A source according to claim 3, wherein the first and the second cavities are housed in a vacuum vessel to prevent deformation of the cavities by atmospheric pressure.

5. An industrial X-ray/electron beam source, comprising:

an electron beam accelerator; and a beam irradiator having a) a two-dimensional scanning magnet which deflects accelerated beam by the accelerator in a vertical direction and in a transverse direction, b) an extracting window for extracting the deflected electron beam to be irradiated to an object, and c) means for guiding the deflected beam toward a center of the extracting window in a radial direction.

6. A source according to claim 5, wherein the means for guiding the beam comprises a magnetic circuit for guiding the beam toward the center of the extracting window by Lorenz force.

7. A source according to claim 6, wherein the magnetic circuit comprises solenoid coils where a current is applied, and two poles defined by a magnetic field produced by the solenoid coils, between the two poles a space for the deflected beam to pass being defined.

8. A source according to claim 5, further comprising, a target for producing X-ray mounted on the extracting window of the irradiator.

9. A source according to claim 6, further comprising, a target for producing X-ray mounted on the extracting window of the irradiator.

10. A source according to claim 7, further comprising, a target for producing X-ray mounted on the extracting window of the irradiator.

* * * * *